United States Patent [19]

Deikel

[11] 4,069,526

[45] Jan. 24, 1978

[54] BED COVERING APPARATUS

[76] Inventor: Theodore Deikel, 27960 Smithtown Road, Shorewood, Minn. 55331

[21] Appl. No.: 744,971

[22] Filed: Nov. 26, 1976

[51] Int. Cl.[2] ..... A47C 23/00; A47G 13/19

[52] U.S. Cl. ..... 5/343; 5/334 R; 5/335

[58] Field of Search ..... 5/334, 343, 344, 335; 24/205 R

[56] References Cited

U.S. PATENT DOCUMENTS

| | | | |
|---|---|---|---|
| 2,736,043 | 2/1956 | Temple | 5/334 R |
| 3,584,323 | 6/1971 | Worley | 5/343 R |

FOREIGN PATENT DOCUMENTS

| | | | |
|---|---|---|---|
| 117,224 | 3/1900 | Germany | 5/334 R |

*Primary Examiner*—Casmir A. Nunberg
*Attorney, Agent, or Firm*—Wicks & Nemer

[57] ABSTRACT

Bed Covering Apparatus is disclosed, in the preferred embodiment, as including a blanket member of a size approximately at least equal to the size of the bed and including first and second coverlet members of a size substantially equal to one-half of the size of the blanket member. The coverlet members are removably and pivotably attached to the center section of the blanket member. The first coverlet member can be pivoted from a first position adjacent to and resting on the right half of the blanket member to a second position adjacent to and resting on the second coverlet member. The second coverlet member can be pivoted from a third position adjacent to and resting on the left half of the blanket member to a fourth position adjacent to and resting on the first coverlet member.

7 Claims, 5 Drawing Figures

BED COVERING APPARATUS

BACKGROUND

This invention relates generally to bed covering apparatus, specifically to bed coverings of a multiplex design, and more specifically to bed coverings of a multiplex design having the ability to vary the layers of the bed covering.

What is desired is bed covering apparatus adapted for a bed for two occupants wherein it is uniquely designed and structurally adapted to better serve the needs and wishes of the individual occupants. Such bed covering apparatus should have thickness varying and warmth changing features.

In the field of bed coverings, various types are currently known and available. Several types of apparatus currently known to be available present serious limitations and deficiencies regarding the ability to pivot coverlets during the night conveniently and with a minimum of effort and in convenience. Presently, types of nonelectric apparatus known to be available include changeable thickness varying panels which are removably attached around their marginal edges along three edges and therefore present a sleeping bag type-effect, include half panels which are connected together, or do not include a multiplex design such as in the present invention.

Therefore, there is a definite need in the art for bed coverings having the ability of the coverlets to pivot during the night conveniently and with a minimum of effort and inconvenience. Further, a need has arisen for a bed covering including a full blanket of a size approximately at least equal to the size of the bed. Further, the bed covering should be of a simple design, efficient, and maximize the materials used.

SUMMARY

The present invention solves these and other problems in bed coverings by providing, in the preferred embodiment, a blanket member of a size approximately at least equal to the size of the bed and including first and second coverlet members. The first and second coverlet members are of the size substantially to one-half the size of the blanket member and are removably and pivotally attached to the center section of the blanket.

Therefore, it is a primary object of this invention, to provide a novel bed covering.

It is further an object of this invention to provide such a novel bed covering of a multiplex design.

It is further an object of the present invention to provide such a novel bed covering of a multiplex design having the ability to vary the layers of bed covering.

It is further an object of the present invention to provide such a novel bed covering having the ability to pivot the coverlets during the night conveniently and with a minimum of effort and inconvenience.

It is further an object of the present invention to provide such a novel bed covering wherein the coverlets are not attached around the marginal edges thereof.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawing where.

Figure 1:
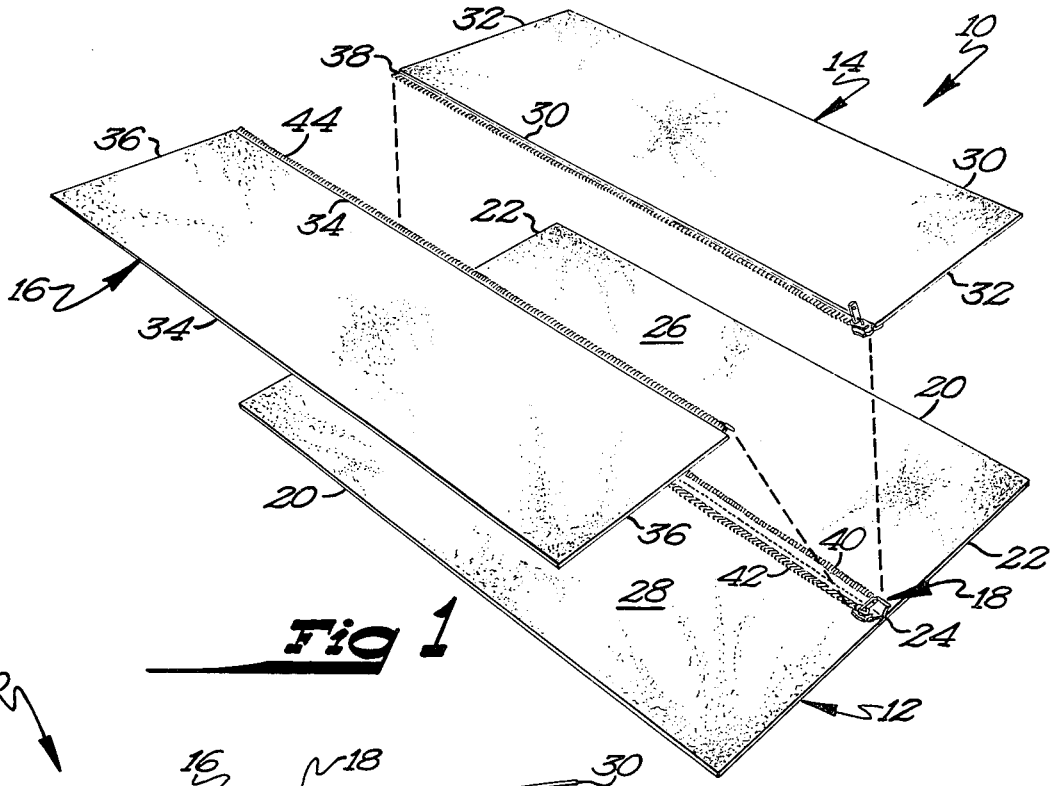
FIG. 1 shows an exploded perspective view of a bed covering according to the teachings of the present invention.

All figures are drawn for ease of explanation of the basic teachings of the present invention only; the extensions of the figures with respect to number, position, relationship, and dimensions of the parts to form the preferred embodiment will be explained or will be obvious from the explanation.

Where used in the various figures of the drawings, the same or similar numerals designate the same or similar parts of the various members of the bed covering. Furthermore, when the terms "right", "left", "length", "width", "right-half", "left-half", "first", "second", "third", "fourth", and similar terms are used herein, it should be understood that these terms have reference only to the structure shown in the drawings as it would appear to a person viewing the drawings and are utilized only to facilitate describing the invention.

DESCRIPTION

In the figures, a bed covering according to the teachings of the present invention is shown and generally designated 10. Covering 10 includes a blanket member 12, a first coverlet member 14, a second coverlet member 16, and members 18 for allowing the first coverlet member to be removably, pivotably attached to the center section of blanket member 12, for allowing second coverlet member 15 to be removably, pivotally attached to the center section of the blanket member 12, and for allowing coverlet member 14 to be pivoted from a first position to a second position and allowing coverlet member 16 to be pivoted from a third position to a fourth position.

Blanket member 12 is formed from any suitable material used in blankets, comforters, or the like. Blanket member 12 is of a size approximately at least equal to the size of the bed or other device upon which it is to be used, and specifically can be of a size corresponding to a full, queen, or king size bed. More particularly, blanket member 12 has a length 20 and a width 22 approximately at least equal to the length and the width, respectively, of the desired size bed. Center section 24 divides blanket member 12 substantially into a right half 26 and a left half 28. Each half, 26 and 28, has a length equal to length 20 of blanket member 12 and a width substantially equal to one-half of the width 22 of blanket member 12.

Coverlet members 14 and 16 are formed from any suitable material used in blankets, comforters, or the like and in the preferred embodiment, are formed from the same material as blanket member 12.

First coverlet member 14 has a size substantially equal to right half 26 of blanket member 12. Specifically, coverlet member 14 has a length 30 which is substantially equal to length 20 of blanket member 12 and has a width 32 substantially equal to one-half of width 22 of blanket member 12.

Second coverlet member 16 has a size substantially equal to left half 28 of blanket member 12. Specifically, coverlet member 16 has a length 34 which is substantially equal to length 20 of blanket member 12 and has a width 36 substantially equal to one-half of width 22 of blanket member 12.

Figure 2:
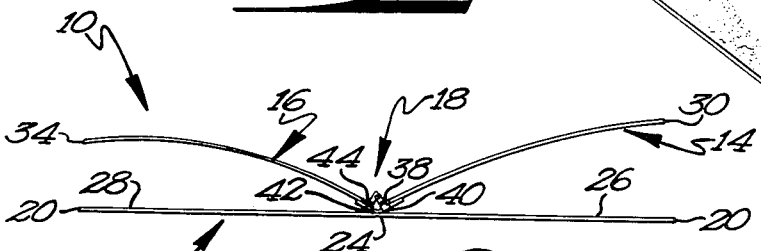
FIG. 2 shows an end view of the bed covering of FIG. 1 in its fifth position.
Figure 3:
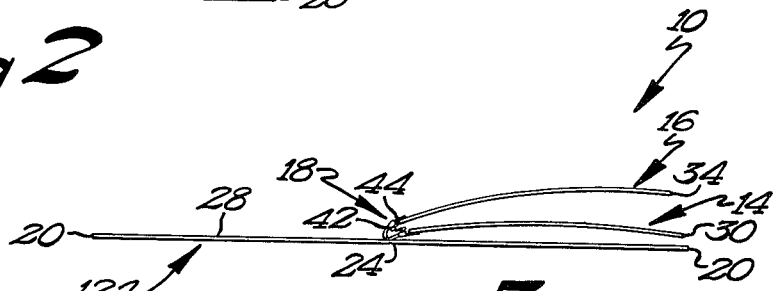
FIG. 3 shows an end view of the bed covering of FIG. 1 in its sixth position.
Figure 4:
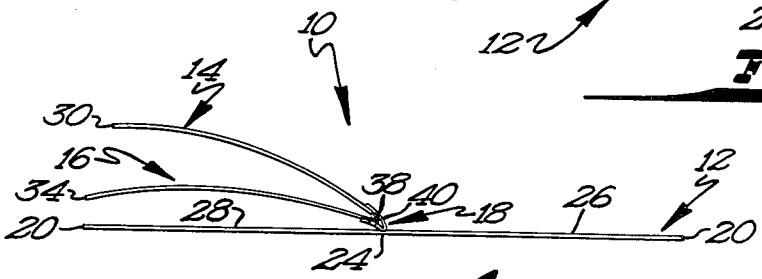
FIG. 4 shows an end view of the bed covering of FIG. 1 in its seventh position.

Member 18 allows coverlet member 14 to be removably, pivotably attached to center section 24 of blanket member 12, allows second coverlet member 16 to be removably, pivotably attached to center section 24 of blanket member 12, and allows first coverlet member 14 to be pivoted from a first position adjacent to and resting on right half 26 of blanket member 12, as best seen in FIGS. 2 and 3, to a second position adjacent to and resting on second coverlet member 16, as best seen in FIG. 4, and allowing second coverlet member 16 to be pivoted from a third position adjacent to and resting on left half 28 of blanket member 12, as best seen in FIGS. 2 and 4, to a fourth position adjacent to and resting on first coverlet member 14, as best seen in FIG. 3. Member 18 includes a first connector member 38 located on one of the lengths 30 of first coverlet member 14, a second connector member 40 located on the blanket member 12 within center section 24 for connecting with first connector member 38, a third connector member 42 located on blanket member 12 within center section 24, and a fourth connector member 44 located on one of the lengths 34 of second coverlet member 16 for connecting with third connector member 42.

It should be noted that, in the preferred embodiment, first connector member 38 is further able to connect with fourth connector member 44 such that the first and second coverlet members 14 and 16 can be connected together. In the preferred embodiment, first, second, third, and fourth connector members 38, 40, 42, and 44 are slide fasteners. Further, in the preferred embodiment, connector members 38 and 42 are of the female slide connector type and second and fourth connector members 40 and 44 are of the male slide connector type.

It can then be noted that bed covering can be positioned in a fifth position, as best seen in FIG. 2, with first coverlet member 14 being located in its first position adjacent to and resting on right half 26 and second coverlet member 16 being located in its third position adjacent to and resting on left half 28.

Bed covering 10 can further be placed in a sixth position, as best seen in FIG. 3, wherein the first coverlet member 14 is located in its first position adjacent to and resting on right half 26 and second coverlet member 16 is located in its fourth position adjacent to and resting on coverlet member 14.

Bed covering 10 can further be placed in a seventh position, as best seen in FIG. 4, with first coverlet member 14 being located in its second position adjacent to and resting on coverlet member 16 and second coverlet member 16 being located in its third position adjacent to and resting on left half 28.

Figure 5:
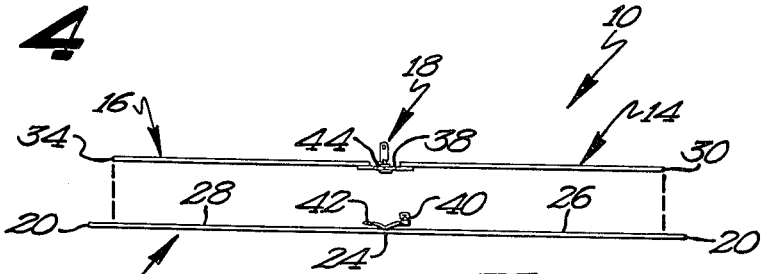
FIG. 5 shows an end view of the bed covering of FIG. 1 in its eighth position.

Additionally, bed covering 10 can further be placed in its eighth position, as shown in FIG. 5, wherein first and second coverlet members 14 and 16 are connected together by connecting members 38 and 44 and wherein blanket member 12 and first and second coverlet members 14 and 16, connected together by first and fourth connector members 38 and 44, form separate bed covering members.

It should then be noted that coverlet members 14 and 16 are not attached around their marginal edges, i.e. along three edges, and therefore do not present a sleeping bag type-effect as did some of the bed coverings of the prior art.

Additionally, it should be noted that bed covering 10 is formed from a full blanket member 12 and two coverlet members 14 and 16 and not several half panels connected together. Therefore, bed covering 10 will not separate during the middle of the night, does not present a rough undersurface which irrates the persons using the covering, and does not allow drafts in the center section of the bed covering as can occur in bed covering formed by half panels connected together as in the known prior art. Further, coverings formed of half panels of the prior art are unable to pivot conveniently during the night with a minimum of effort and inconvenience. Such known coverings were intended to remain in a single position and were not intended to allow pivoting thereof into several positions, as with the bed covering of the present invention.

According to the present invention, coverlet members 14 and 16 have the ability to pivot during the night conveniently and with a minimum of effort and inconvenience. Therefore, assuming for the sake of example that covering 10 is in its sixth position, as shown in FIG. 3, if the person located under right half 26 of blanket 12 becomes warm during the middle of the night, (s)he can pivot coverlets 14 and 16 such that covering 10 is in its fifth position as shown in FIG. 2 or such that covering 10 is in its seventh position as shown in FIG. 4. Further, covering 10 of the present invention provides a smooth top surface.

Now that the basic teachings of the present invention have been explained, many extensions and variations will be obvious to one having ordinary skill in the art. For example, although member 18 is shown in its preferred form as being connector members 38, 40, 42 and 44 allowing removably and pivotably attachment, other types of pivotable attachment members will be obvious to one skilled in the art in view of the teachings of the present invention and are intended to be included in the present invention, as defined in the appended claims.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Bed covering for use with a bed having a length and a width comprising, in combination: a first blanket member having a length and a width approximately at least equal to the length and width of the bed and having a center section dividing the blanket member substantially into a right half and a left half, with each of the right and left halves having a length equal to the length of the blanket member and a width substantially equal to one half the width of the blanket member; a first coverlet member having a size substantially equal to the right half of the blanket member; a second coverlet member having a size substantially equal to the left half of the blanket member; and means for allowing the first coverlet member to be removably, pivotably attached to the center section of the blanket, for allowing the second coverlet member to be removably, pivotably attached to the center section of the blanket, and for allowing the first coverlet member to be pivoted from a first position adjacent to and resting on the right half of the blanket member to a second postion adjacent to and resting on the second coverlet member and allowing the second coverlet member to be pivoted from a third position adjacent to and resting on the left half of the blanket member to a fourth position adjacent to and resting on the first coverlet member comprising, in combination: a first connector member located on the first coverlet member; a second connector member located on the blanket member within the center section for connecting with the first connector member; a third connector member located on the blanket member wthin the center section; and a fourth connector member located on the second coverlet member for connecting with the third connector member wherein the bed covering can be positioned in a fifth position with the first coverlet member located in its first position and the second coverlet member located in its third position; a sixth position with the first coverlet member located in its first position and the second coverlet member located in its fourth position; and a seventh position with the first coverlet member located in its second position and the second coverlet member located in its third position.

2. The bed covering of claim 1 wherein the first connector member further connects with the fourth connector member such that the first and second coverlet members can be connected together wherein the bed covering can be positioned in an eighth position wherein the blanket member and the first and second coverlet members, connected together by the first and fourth connector members, form separate bed covering members.

3. The bed covering of claim 2 wherein the first, second, third, and fourth connector members are slide connectors.

4. The bed covering of claim 3 wherein one of the second and third connecting members is of the male slide connector type and the other of the second and third connecting members is of the female slide connector type.

5. The bed covering of claim 2 wherein one of the second and third connecting members is of the male connector type and the other of the second and third connecting members is of the female connector type.

6. The bed covering of claim 1 wherein the first, second, third, and fourth connector members are slide connectors.

7. The bed covering of claim 6 wherein one of the second and third connecting members is of the male slide connector type and the other of the second and third connecting members is of the female slide connector type.

* * * * *